US007374066B2

(12) United States Patent
Jackson et al.

(10) Patent No.: US 7,374,066 B2
(45) Date of Patent: May 20, 2008

(54) DISPENSER FOR A FLOWABLE PRODUCT

(75) Inventors: Simon Alexander Jackson, Rooihuiskraai (ZA); John Edward Lewthwaite, Boksburg (ZA); Deanna Lowitt, Greenside (ZA)

(73) Assignee: Roger Basil Lawson Scheepers, Sandton (ZA)

( * ) Notice: Subject to any disclaimer, the term of this patent is extended or adjusted under 35 U.S.C. 154(b) by 297 days.

(21) Appl. No.: 10/483,609

(22) Filed: Jul. 12, 2004

(65) Prior Publication Data

US 2004/0251271 A1 Dec. 16, 2004

(30) Foreign Application Priority Data

Jul. 13, 2001 (ZA) ..... 2001/5791

(51) Int. Cl.
*B67D 5/08* (2006.01)

(52) U.S. Cl. ..... 222/52; 222/63; 222/190; 239/343

(58) Field of Classification Search ..... 222/63, 222/44, 190, 325, 333, 404, 62, 52, 189.03, 222/189.04, 838.1, 181.3, 362, 385, 180; 239/343–346, 366–370
See application file for complete search history.

(56) References Cited

U.S. PATENT DOCUMENTS 4,722,372 A * 2/1988 Hoffman et al. ..... 141/98
5,180,753 A * 1/1993 Osipow et al. ..... 521/65
5,810,201 A 9/1998 Besse et al.
6,045,779 A * 4/2000 Mueller et al. ..... 424/47
6,056,947 A * 5/2000 Kahre et al. ..... 424/70.13
6,468,516 B1 * 10/2002 Geria et al. ..... 424/73
6,568,561 B2 * 5/2003 Studer et al. ..... 222/63

FOREIGN PATENT DOCUMENTS

EP 0 468 062 1/1992
EP 1 099 400 5/2001

* cited by examiner

*Primary Examiner*—Lien M. Ngo
(74) *Attorney, Agent, or Firm*—Buchanan Ingersoll & Rooney PC

(57) ABSTRACT

A dispenser for a flowable product such as liquid soap is arranged to receive a can containing the liquid soap as well as two different propellants. Gaseous nitrogen under pressure acts as a primary propellant, while propane and/or butane in a liquid phase acts to foam the soap when it is released from the can. An electronically controlled valve is actuated when a sensor detects the presence of a user's hand adjacent an outlet, and a predetermined quantity of foamed soap is then dispensed.

10 Claims, 4 Drawing Sheets

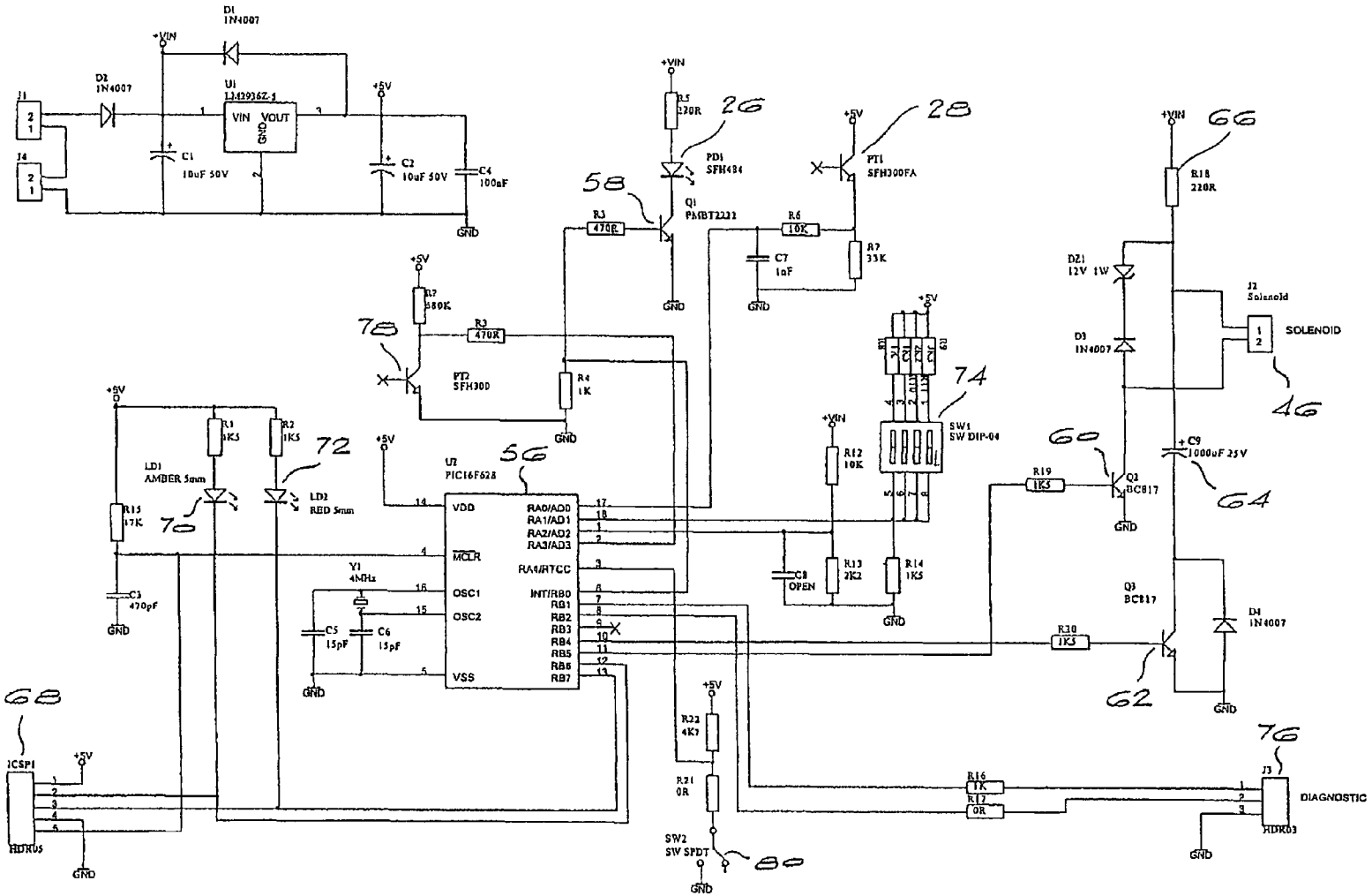
SOLENOID
DIAGNOSTIC
SW1 SW DIP-04
SW2 SW SPDT
U2 PIC16F628
U1 LM2931CZ-5
VIN
VOUT
GND
+5V
+VIN
RA0/AD0
RA1/AD1
RA2/AD2
RA3/AD3
RA4/RTCC
INT/RB0
RB1
RB2
RB3
RB4
RB5
RB6
RB7
VDD
MCLR
OSC1
OSC2
VSS
LD2 RED 5mm
LD1 AMBER 5mm
ICSP1
HDR05
J1 Solenoid
J3
J4
D1 1N4007
D2 1N4007
D3 1N4007
D4 1N4007
DZ1 12V 1W
Q1 PN3BT2221
Q2 BC817
Q3 BC817
PD1 SFH484
PT1 SFH300FA
PT2 SFH300
Y1 4MHz
C1 10uF 50V
C2 10uF 50V
C3 470pF
C4 100uF
C5 15pF
C6 15pF
C7 1uF
C8 OPEN
C9 1000uF 25V
R1 1K5
R2 1K5
R3 470R
R4 1K
R5 470R
R6 10K
R7 33K
R8 380K
R9 470R
R10 470R
R11 10K
R12 10K
R13 2K2
R14 1K5
R15 17K
R16 1K
R17 0R
R18 220R
R19 1K5
R20 1K5
R21 0R
R22 4K7
J2
J5
J6
J7
J8
J9
J10
J11
J12
J13
J14
J15
J16
J17
J18
J19
J20
J21
J22
J23
J24
J25
J26
J27
J28
J29
J30
J31
J32
J33
J34
J35
J36
J37
J38
J39
J40
J41
J42
J43
J44

DISPENSER FOR A FLOWABLE PRODUCT

BACKGROUND OF THE INVENTION

THIS invention relates to a dispenser for a flowable product such as a liquid soap.

Soap dispensers are widely used in corporate and public washrooms, in preference to soap in bar form. Most such dispensers contain liquid soap, which may be refilled from bulk containers into an open receptacle, or they may accept sealed cartridge type refills. Although the former are generally less expensive to operate, the sealed cartridge type is generally preferred as the refill contents cannot be tampered with and are generally more hygienic. It is also generally less easy to pilfer the contents of the cartridge, other than by depressing the dispenser lever continuously. Of the latter kind of dispenser, a number generate a foam, rather than merely dispensing a liquid or gel. Customers generally prefer the superior cleansing effect of the foam, and pilferage is largely eliminated as the foam cannot usefully be collected in any quantity. Known foam soap dispensers work either by the operation of a lever which generates air pressure in the dispensing system, or by means of a motorised pump which generates sufficient pressure in a reservoir of liquid soap to create foam.

Although an automatically operated device is preferred, it will be appreciated that a motor driven pump is relatively energy inefficient, and that the device would therefore normally need to be mains operated or, if battery operated, the service intervals for such a device would inevitably be short.

It is an object of the invention to provide an alternative dispenser for flowable products such as soap, which is more energy efficient but nevertheless highly effective.

SUMMARY OF THE INVENTION

According to the invention a dispenser for a flowable product comprises:

- a base adapted to support a reservoir containing a quantity of the product and a propellant;
- an electronically controllable valve with an associated dispensing outlet, the valve being responsive to a control signal to release a predetermined quantity of the product via the outlet;
- a sensor arranged to detect the presence of a human hand or other receptacle and to generate a sensor output signal; and
- a control circuit responsive to the sensor output signal to generate a control signal, thereby to cause the release of a predetermined quantity of the product.

The product may be a soap, for example, or any other flowable substance required to be dispensed in predetermined quantities in a "hands free" manner.

The reservoir may contain a first, gaseous propellant, and a quantity of the product mixed with a second propellant in a liquid phase.

For example, the product may be a liquid soap and the first propellant may be nitrogen gas, while the second propellant may comprise propane and/or butane gas in a liquid phase.

The sensor may comprise a light source and a light detector arranged so that the presence of a human hand or other receptacle for the product adjacent the outlet causes light from the source to be reflected to the detector, generating a sensor output signal.

The control circuit is preferably microprocessor based, permitting the duration of the control signal which operates the valve to be varied according to the type of product being dispensed and other operational requirements.

The invention extends to a container for use with the dispenser, the dispenser containing a first, gaseous propellant, and a quantity of a flowable product mixed with at least one second propellant in a liquid phase.

BRIEF DESCRIPTION OF THE DRAWINGS

FIG. 4A is a sectional view taken along line 4A-4A in FIG. 4;

FIG. 6 is a detailed circuit diagram of the electronic circuit board shown in FIG. 5.

DESCRIPTION OF AN EMBODIMENT

Figure 1:
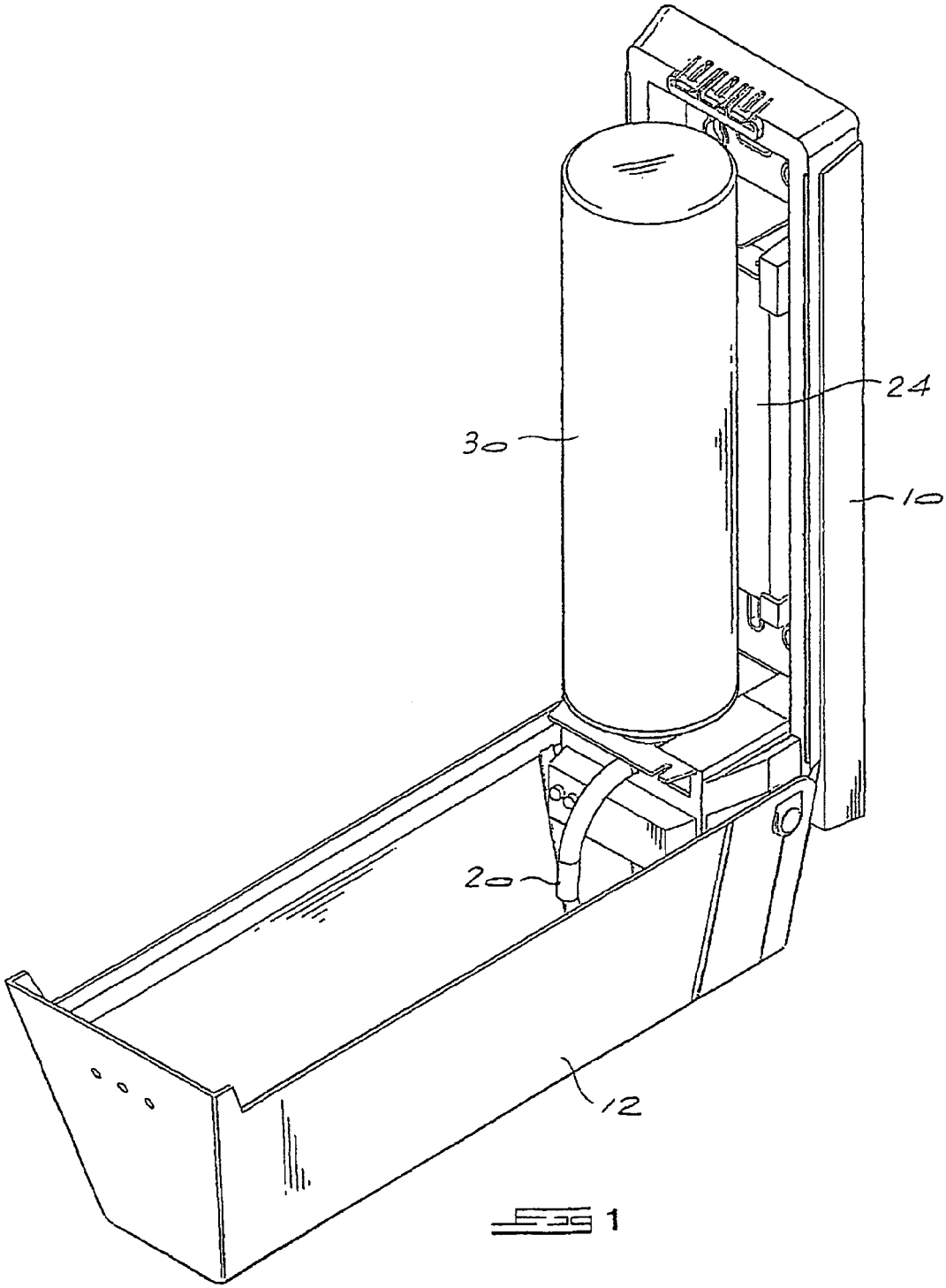
FIG. 1 is a pictorial view of a dispenser for a flowable product according to the invention.
Figure 2:
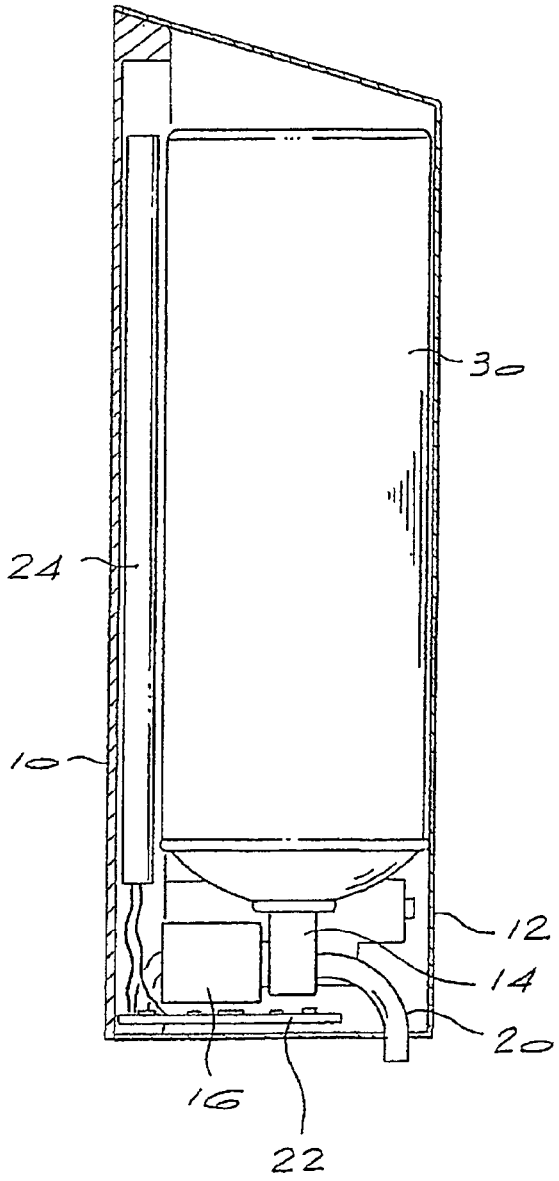
FIG. 2 is a schematic side view of the dispenser of FIG. 1.
Figure 3:
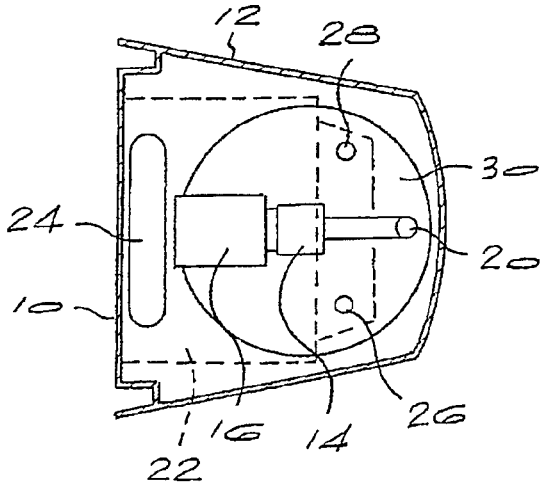
FIG. 3 is a schematic bottom view corresponding to the side view of FIG. 2.

FIGS. 1, 2 and 3 show a dispenser for a flowable product such as liquid soap according to the invention. The device has a housing comprising a base plate 10 which can be mounted on a wall or another suitable support surface, and a removable cover 12 which is generally channel shaped. As seen in FIG. 1, the cover is hinged to the base plate. Within the housing is a valve 14 controlled by a solenoid 16 and having an associated outlet or nozzle 20. The solenoid 16 is controlled by an electronic circuit on a circuit board 22 which is in turn powered by a battery pack 24. Where a source of electricity is readily available, a mains power supply can be used instead of a battery pack. The circuit board is conveniently located at the end of the housing, adjacent the valve and its solenoid, as shown.

The device includes a sensor arrangement comprising a light source such as an infra-red LED 26 and a corresponding infra-red phototransistor or other light detector 28. The light source and the detector are angled inwardly on either side of the outlet or nozzle 20, so as to detect the presence of a human hand (or other receptacle for the product) at a suitable distance from the nozzle for dispensing of the product. When a hand is brought into the correct position, light from the source 26 is reflected relatively strongly to the photodiode 26, resulting in a sensor output signal which is amplified and processed by the electronic control circuit 22. (The operation of the circuit is discussed below with reference to FIGS. 5 and 6.)

Figures 4, 5:
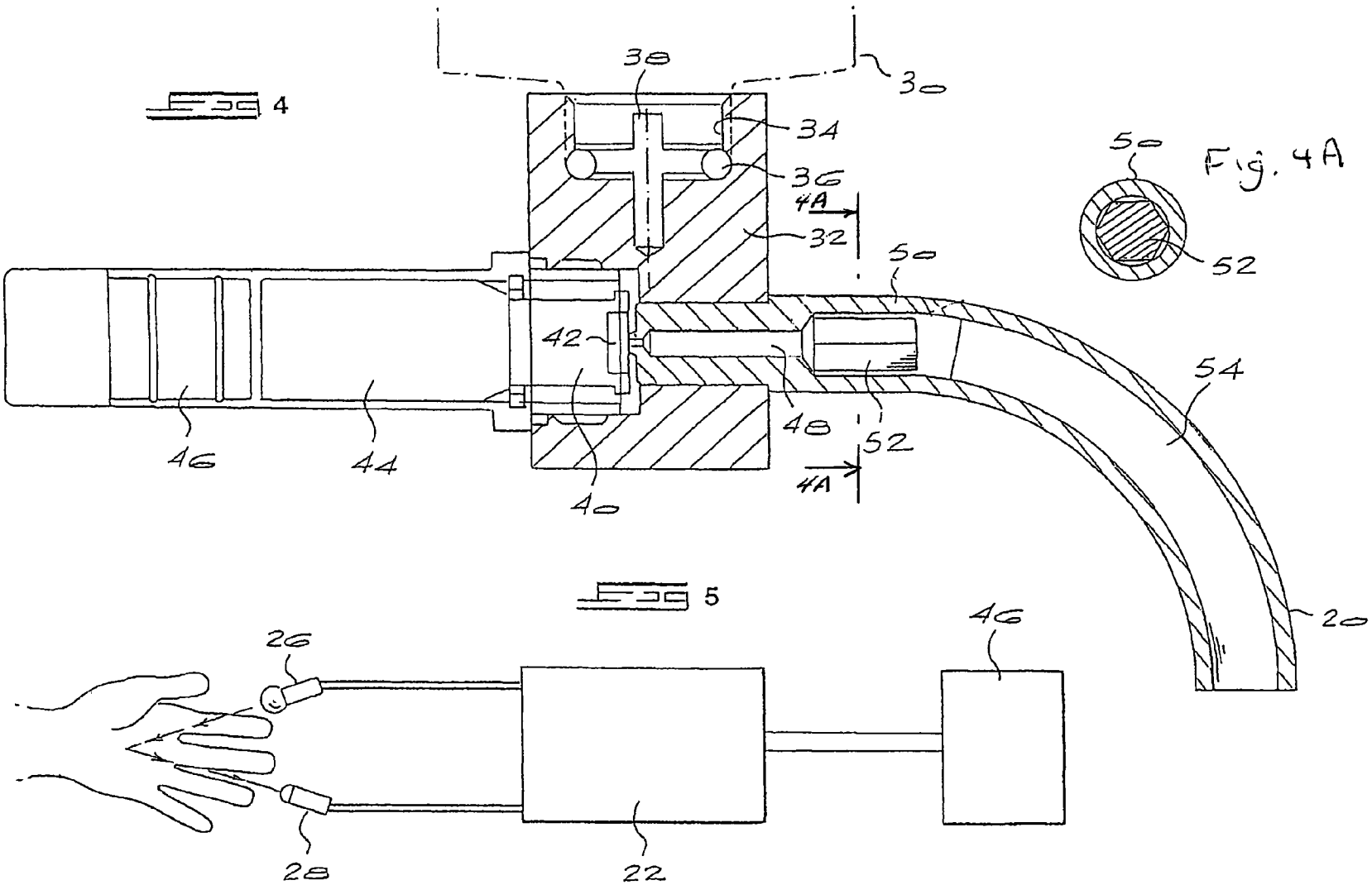
FIG. 4 is a partial sectional side view of a dispensing valve and canister of the dispenser.
FIG. 5 is a highly simplified block diagram of the electronic circuitry of the dispenser.

The valve and reservoir arrangement of the device is shown in greater detail in FIG. 4. The reservoir or container 30 is preferably a seamless aluminum aerosol can designed to withstand a pressure of 1375 kPa without bulging and a pressure of 1860 kPa without bursting. Such cans are permitted to be filled to a pressure of 1275 kPa. Alternatively, an internally lacquered tin-plated steel can could be used. In the prototype device of the invention, the flowable product within the can was a liquid soap comprising a blend of surfactants, emulsifiers and emollient oils. The soap was mixed with both propane and n-butane and the can was filled to approximately 90% of its capacity with this liquid mixture. In addition, nitrogen gas at a pressure of approximately 900 kPa was introduced into the can as a primary propellant.

The nitrogen gas serves as the main propellant or power source within the can, for expelling the product from the can via the valve and out of the nozzle or outlet. The propane and n-butane are secondary propellants, which are designed to cause a foaming effect within the product as it is expelled, due to gasification and expansion of the propane and n-butane. The proportions of the product, the primary and secondary propellants and the extent to which the can is filled affect the characteristics of the dispensed product, and in the prototype dispenser were selected to give a particularly creamy or foamy effect, typically resulting in an expansion of the product of up to 10 times the volume in the liquid state thereof.

The valve is illustrated in greater detail in FIG. 4. The valve body 32 is machined from brass and defines a threaded inlet 34 which receives the threaded mouth of the aerosol can 30. The inlet has a carefully machined seat and an O-ring seal of VITON (trade mark) material in order to provide a good seal. An operating pin 38 is located centrally and co-axially within the inlet 34 and is arranged to puncture a seal at the mouth (valve) end of the can as it is screwed into position.

The valve has a poppet 40 with a seat 42, and an armature 44 which is controlled by a solenoid coil 46. When the solenoid is operated, the armature moves back slightly from the seat 42, allowing a small quantity of the highly pressurised product to escape into an expansion chamber 48 defined at the innermost end of the outlet 50. Adjacent the expansion chamber 48 is a diffusing chamber fitted with a brass plug or body 52 which has a hexagonal section and which allows the product to expand, under the influence of the secondary propellants, between the plug and the inner wall of the diffusing chamber. The curved portion 54 of the nozzle serves as a mixing chamber for the foaming product.

The circuit diagram of FIG. 6 shows the control circuit 22 of FIG. 5 in greater detail. The circuit is based on a PIC16F628 microprocessor 56 which drives the infrared LED 26 via a transistor 58, and which has an input which monitors the output of the phototransistor light sensor 28. The microprocessor 56 drives the solenoid 16 via a pair of outputs which control respective driver transistors 60 and 62. In a standby mode, the transistor 62 is turned on, allowing a capacitor 64 to be charged to 12 volts from the battery pack 24, via a series resistor 66. In the prototype, the RC time constant of the capacitor 64 and the resistor 66 was chosen to be about 200 ms, so that the capacitor charges up in well under a second, but nevertheless ensuring that only a relatively small current charges the capacitor.

When the presence of a user's hand is detected, the transistor 60 is driven on, discharging the capacitor 64 into the solenoid coil 46 and providing the requisite high current pulse to operate the valve. This avoids subjecting the battery pack to high current discharge pulses and ensures consistency of operation of the solenoid. In a variation of this arrangement, the capacitor can be charged after detection of a user's hand, to avoid the need to maintain the charge on the capacitor for lengthy periods.

In operation, the device is normally in a stand-by condition, waiting for the approach of a user. When the sensor comprising the light source 26 and the photodiode 28 detects the presence of a user's hand, the solenoid is caused to operate briefly, opening the valve for a predetermined brief period (adjustable between 0.1 and 0.6 ms in the prototype) and allowing a dose of approximately 0.5 ml to pass through the valve, and thus dispensing a quantity of foamed or creamed soap into the user's hand.

In a more sophisticated version of the device, the LED 26 can be pulsed and phase change information in the detected, reflected pulses can be used by the microprocessor to decide when the user's hand (or another receptacle) is correctly in position.

The use of a microprocessor with flash memory makes it possible to adjust the operating characteristics of the device readily, either during manufacture or from time to time in the field. An In-Circuit Serial Programming (ICSP) port 68 is provided to allow in-the-field programming, allowing different operating parameters, delay times and modes to be set.

The electronic circuit is fitted with a light sensor comprising a phototransistor 78 to deactivate the device at night. This conserves battery energy. A 12 hour/24 hour selector switch can be provided to enable or disable this feature. An LED indicator 70 is provided to indicate a "battery low" condition and another indicator 72 indicates that a predetermined number of operating cycles have been reached.

Use is made of DIP switches 74 to set one of a number of different pre-programmed valve operating periods for different products. This enables precise control of the dosage of the flowable product. The DIP switches also select the 12 or 24 hour mode. If the microcontroller senses the DIP switch settings as well as the number of dispensing pulses or operating cycles, it can be calibrated to calculate the amount of product remaining in the can 30, and to illuminate an indicator when the can is expected to be empty or nearly empty.

A reed switch 80 on the base plate, with a corresponding magnet on the cover, disables the circuit when the cover is opened, for example, to replace the can 30. A microswitch could be used instead.

An RS 232 port 76 allows the configuration of the device to be read for diagnostic purposes. Finally, a predetermined "lock-out" delay can be set to prevent repeated operation of the dispenser before a predetermined time delay has elapsed.

The described dispenser has a number of advantageous features. Due to the use of a sealed, pressurised can or canister, the shelf life of the flowable product (particularly if it is light sensitive) may be increased. The use of replaceable sealed cans also enhances hygiene.

The use of the above described dispenser is not limited to liquid soap and the like. For example, the device can be used to dispense oils or other industrial liquids in a workshop environment. In a medical environment, the apparatus can be used to dispense quick drying hand sanitizing fluids and the like, or for dispensing medical grade disinfectant foam. In the area of food preparation, the apparatus can be used to dispense food grade products such as mousses, creams and toppings. In the beauty industry, the device can be used to dispense shampoos and hairconditioners, or beauty creams and massage oils, for example. Similarly, the device could be used to dispense oils and other fluids used in physiotherapy. Other applications for the invention will occur to those skilled in the art.

The invention claimed is:

1. A dispenser for a flowable product comprising:

a reservoir containing a first, gaseous propellant, and a quantity of the flowable product mixed with a second propellant in a liquid phase, so that the second propellant expels the product from the reservoir and causes foaming of the product as it is expelled, wherein the product is released from the reservoir in a foamy state;

a base adapted to support said reservoir;

an electronically controllable valve with an associated dispensing outlet, the valve being responsive to a control signal to release a predetermined quantity of the product via the outlet;

a sensor arranged to detect the presence of a human hand or other receptacle and to generate a sensor output signal;

a control circuit responsive to the sensor output signal to generate the control signal, thereby to cause the release of the predetermined quantity of the product;

an expansion chamber communicating with an outlet of the reservoir in which the flowable product expands;

a diffusing chamber communicating with the expansion chamber and including a central body for directing the expanding product laterally outwardly; and a mixing chamber communicating with the diffusing chamber in which the product mixes and foams.

2. A dispenser according to claim 1 wherein the flowable product is a soap.

3. A dispenser according to claim 2 wherein the product is a liquid soap and the first propellant is nitrogen gas.

4. A dispenser according to claim 3 wherein the second propellant comprises propane and/or butane gas in a liquid phase.

5. A dispenser according to claim 1 wherein the sensor comprises a light source and a light detector arranged so that the presence of a human hand or other receptacle for the product adjacent the outlet causes light from the source to be reflected to the detector, generating a sensor output signal.

6. A dispenser according to claim 1 wherein the control circuit is microprocessor based, permitting the duration of the control signal which operates the valve to be varied according to the type of product being dispensed and other operational requirements.

7. A dispenser according to claim 6 wherein the control circuit includes an adjustable switch arranged to vary the opening period of the valve between 0.1 and 0.6 ms.

8. A container according to claim 1 wherein the flowable product is a liquid soap.

9. A container according to claim 1 wherein the first propellant is nitrogen gas.

10. A container according to claim 1 wherein the second propellant comprises propane and/or butane gas in a liquid phase.

* * * * *